US005238363A

United States Patent [19]

Thielke et al.

[11] Patent Number: 5,238,363

[45] Date of Patent: Aug. 24, 1993

[54] DUAL SUCTION VERTICAL PUMP WITH PENDANT AUGER

[75] Inventors: Bruce R. Thielke, Salt Lake City; James V. Mangano, Sandy, both of Utah

[73] Assignee: Baker Hughes Incorporated, Houston, Tex.

[21] Appl. No.: 972,867

[22] Filed: Nov. 4, 1992

Related U.S. Application Data

[63] Continuation of Ser. No. 845,861, Mar. 3, 1992, abandoned, which is a continuation of Ser. No. 619,679, Nov. 29, 1990, abandoned, which is a continuation of Ser. No. 312,436, Feb. 17, 1989, abandoned, which is a continuation of Ser. No. 114,583, Oct. 30, 1987, abandoned.

[51] Int. Cl.[5] ..... F04D 29/70

[52] U.S. Cl. ..... 415/121.2; 415/143; 366/264; 366/295; 417/424.1

[58] Field of Search ..... 415/121.1, 121.2, 121.3, 415/143, 901, 903; 366/262–265, 293; 417/424.1

[56] References Cited

U.S. PATENT DOCUMENTS

| | | | |
|---|---|---|---|
| 2,179,730 | 11/1939 | Ruthman | 415/121 G |
| 2,460,757 | 2/1949 | Kurz | 366/264 |
| 2,808,782 | 10/1957 | Thompson et al. | 415/121 G |
| 2,916,091 | 12/1959 | Caudill | 415/501 |
| 3,369,492 | 2/1968 | Berman | 415/501 |
| 3,741,531 | 6/1973 | Chaplygin et al. | 415/143 |
| 3,751,178 | 8/1973 | Paugh et al. | 415/143 |
| 3,973,866 | 8/1976 | Vaughan | 415/143 |
| 4,456,424 | 6/1984 | Araoka | 415/143 |
| 4,604,035 | 8/1986 | Robert | 415/121.1 |
| 4,650,342 | 3/1987 | Goodwin | 415/143 |
| 4,728,256 | 3/1988 | Araoka | 415/121.2 |

FOREIGN PATENT DOCUMENTS

| | | | |
|---|---|---|---|
| 1403263 | 10/1968 | Fed. Rep. of Germany | 415/121 B |
| 2070687 | 9/1981 | United Kingdom | 415/121 G |

*Primary Examiner*—John T. Kwon

*Attorney, Agent, or Firm*—Trask, Britt & Rossa

[57] ABSTRACT

A double-suction, submerged pump fitted with an agitator beneath its lower suction inlet is disclosed. The pump intended particularly for use as a slurry pump is driven by an elongated drive shaft by a remote motor. The motor and drive shaft bearings are located in a substantially non-corrosive, non-erosive environment above the body of slurry being pumped.

5 Claims, 2 Drawing Sheets

DUAL SUCTION VERTICAL PUMP WITH PENDANT AUGER

This application is a continuation, of application Ser. No. 07/845,861, filed Mar. 3, 1992 continued from 07/619,679 filed Nov. 29, 1990, continued from 07/312,436 filed Feb. 17, 1989 continued from 7/114,583 filed Oct. 30, 1987, all of them abandoned.

FIELD

This invention relates to vertically-oriented, centrifugal, submerged, slurry pumps.

BACKGROUND

Vertically-oriented, centrifugal, slurry pumps have been used effectively in slurry tanks for quite some time. Both single suction and dual suction pumps have been utilized. A dual suction pump of a conventional submerged type is illustrated in FIG. 1 as a prior art device.

These dual suction pumps, especially of the type illustrated in FIG. 1, are submerged pumps having an elongated vertical shaft which drives a pump impeller by a remote motor located above the slurry. In a typical dual suction submerged pump, no bearings are exposed or located below the slurry level. These vertical pumps have been used to pump slurries resulting from coal pile runoff, floor washdown, lime mud, fly ash, industrial waste transfer, pickling/plating solutions, mill scale, pulp and paper mill liquids, and the like. The cantilever shaft design permits bearings, seals, etc. to be remote from any corrosive or erosive environment.

Recently, submerged pumps in which the motor and the pump are constructed as a compact, submerged unit have been introduced as slurry pumps. Pumps of this type have been used frequently in dredging operations and are illustrated in the following U.S. Pat. Nos. 4,456,424 to Araoka, 4,650,342 to Goodwin, 4,604,035 to Roberts, 3,741,531 to Chaplygin, et al., 3,873,866 to Vaughan.

These patents generally relate to a centrifugal pump with an auger located below a single, downwardly directed pump inlet. The auger may function slightly differently in these various devices. For example, in Araoka the auger is intended to direct liquid away from the pump and agitate solids such as sand located in a river bed. In contrast, the device of Goodwin is structured to force liquid-containing solids axially towards the pump impeller. The Chaplygin patent discloses a device having a canopy which deflects liquid flow downward to then be sucked upwards through the lower inlet of a single inlet pump.

The Vaughan device is one which a chopping blade is placed underneath a single inlet pump to prevent large agglomerates from entering the pump casing.

A disadvantage of auger equipped submersible pumps having a single inlet proximate the auger is that the agitating action of the auger combined with the suction action of the impeller tends to create a somewhat localized effect. For dredging operations in a very large body of water, e.g. a river, in which the whole purpose of the activity is to remove solids from the bottom, such localized action not only may be readily tolerated, but may be actually desired. However, in a vessel containing a slurry, it is usually desired that the slurry particles be substantially uniformly distributed throughout the slurry. Thus, more than mere localized hydraulic flows are desired in a slurry tank. For example, if hydraulic flow is localized in a slurry tank, the slurry particles may not stay in suspension at points remote from the site of the agitation action.

In pumps of the single inlet type which are known in the prior art, a further disadvantage resides in the fact that these pumps generally require submerged seals and bearings.

DESCRIPTION OF THE INVENTION

Figure 1:
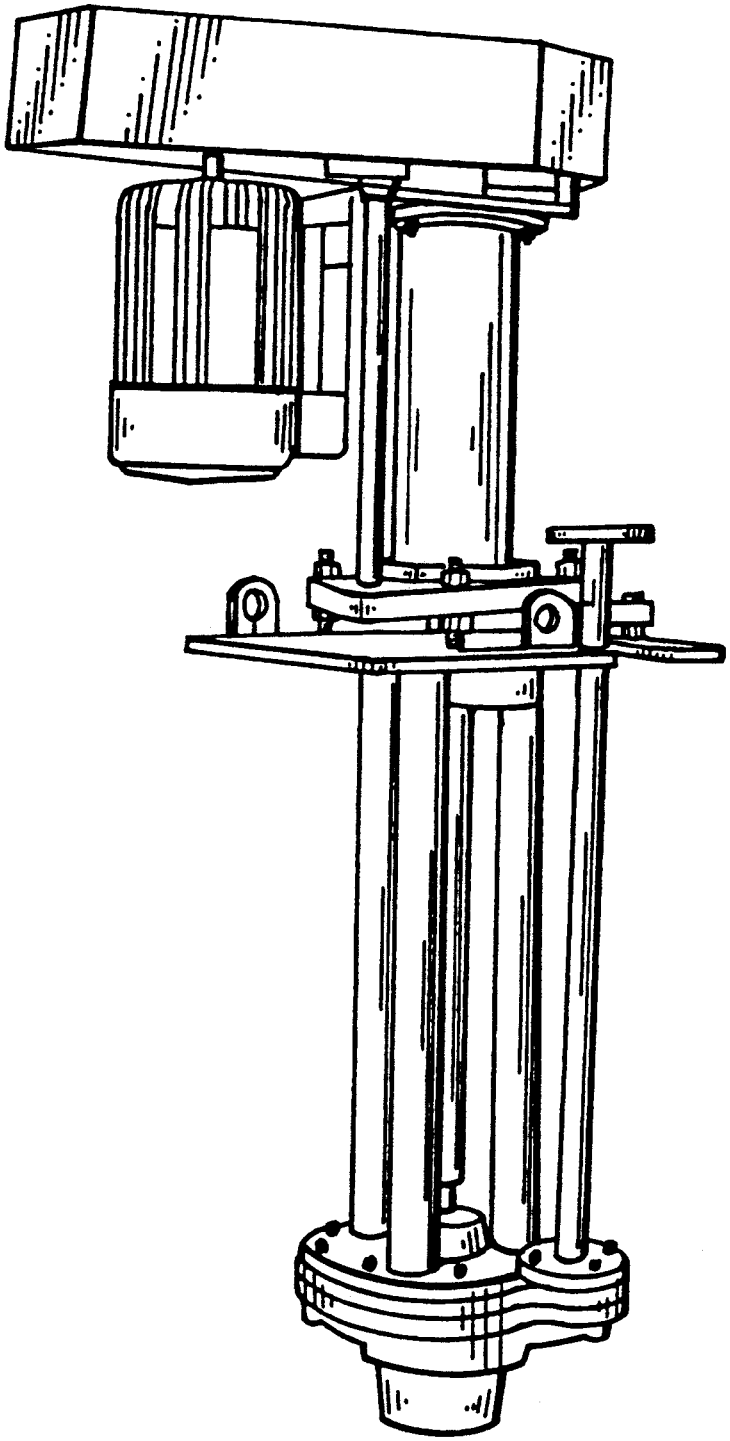
Fig. 1 (PRIOR ART)
FIG. 1 is an elevational view of a prior art dual suction, vertically-oriented, submerged slurry pump having a remote motor.

The instant invention relates to vertically-oriented, dual inlet, submerged centrifugal pumps having a remote motor and an auger fitted to a drive shaft extension to extend below a lower inlet of the pump. The invention further relates to retrofit kits for existing dual suction vertically-oriented, submerged centrifugal pumps comprising a modified impeller, a stub extension shaft and an auger and a cylindrical strainer case.

A dual suction, vertically-oriented, centrifugal slurry pump of the instant invention comprises a pump motor connected by an elongated vertical drive shaft at right angles to the central disk of an impeller of a submerged pump. Preferably, an elongated tubular pipe concentric about the drive shaft supports the pump housing at its lower end and is fixed to the motor support plate or similar support at its upper end.

The drive shaft is cantilevered from bearings located remote from the pump impeller so that no submerged bearings or seals are required. Attached to one end of the drive shaft is a dual action impeller having a central, solid flat circular disk with impeller vanes on each face of the disk. Feed ports as inlets for the impeller are centrally located in the pump housing on opposite sides of the impeller disk so that liquid is introduced on each side of the disk near its center.

The openings in the screens are smaller than the minimum distance between adjacent vanes of the impeller.

The drive shaft extends above the motor support plate for a short distance, passing through a bearing adjacent the support plate and another bearing near the upper terminus of the drive shaft. A spaced, dual bearing arrangement lends greater stability to the drive shaft and generally minimizes vibrations and shaft deflection near its lower end.

The elongated drive shaft passes through the upper pump inlet opening with sufficient clearance to permit slurry particles and even slurry agglomerates to pass between the shaft and the inlet opening. An elongated tubular support pipe generally surrounds the upper inlet opening and is punctured with numerous ports or vents to permit liquid to enter the upper pump inlet. A stub shaft depends from and is secured axially to the impeller hub wherein the stub shaft is axially aligned with the central longitudinal axis of the drive shaft. The stub shaft passes through the lower inlet opening of the pump housing.

At the free end of the stub shaft is attached an agitator element. The agitator element generally depends below the lower inlet opening a distance approximately equivalent to the height of the agitator.

Screen elements are usually associated with the upper and lower openings of the pump to limit the size of particles or agglomerates which may pass into the pump inlets. No particles or agglomerates larger than the minimum clearance between adjacent vanes should be permitted to pass into the pump.

Further description of the invention may be facilitated by reference to the attached drawings. In FIG. 2, an elevational, partial sectional view of the double suction submerged centrifugal pump is illustrated. A drive shaft 10 is connected to a remote motor (not shown) and is anchored at its upper end in a bearing mounting (not shown) and attached at its lower end to an impeller 11. (The motor mounting and support plate for the pump of FIG. 2 may be the same or similar to that illustrated in FIG. 1). The impeller 11 is a dual acting impeller with a solid, thin, disk-like center 12 with propulsion vanes 13 and 14 on the top and bottom faces of the impeller disk.

Figure 2:
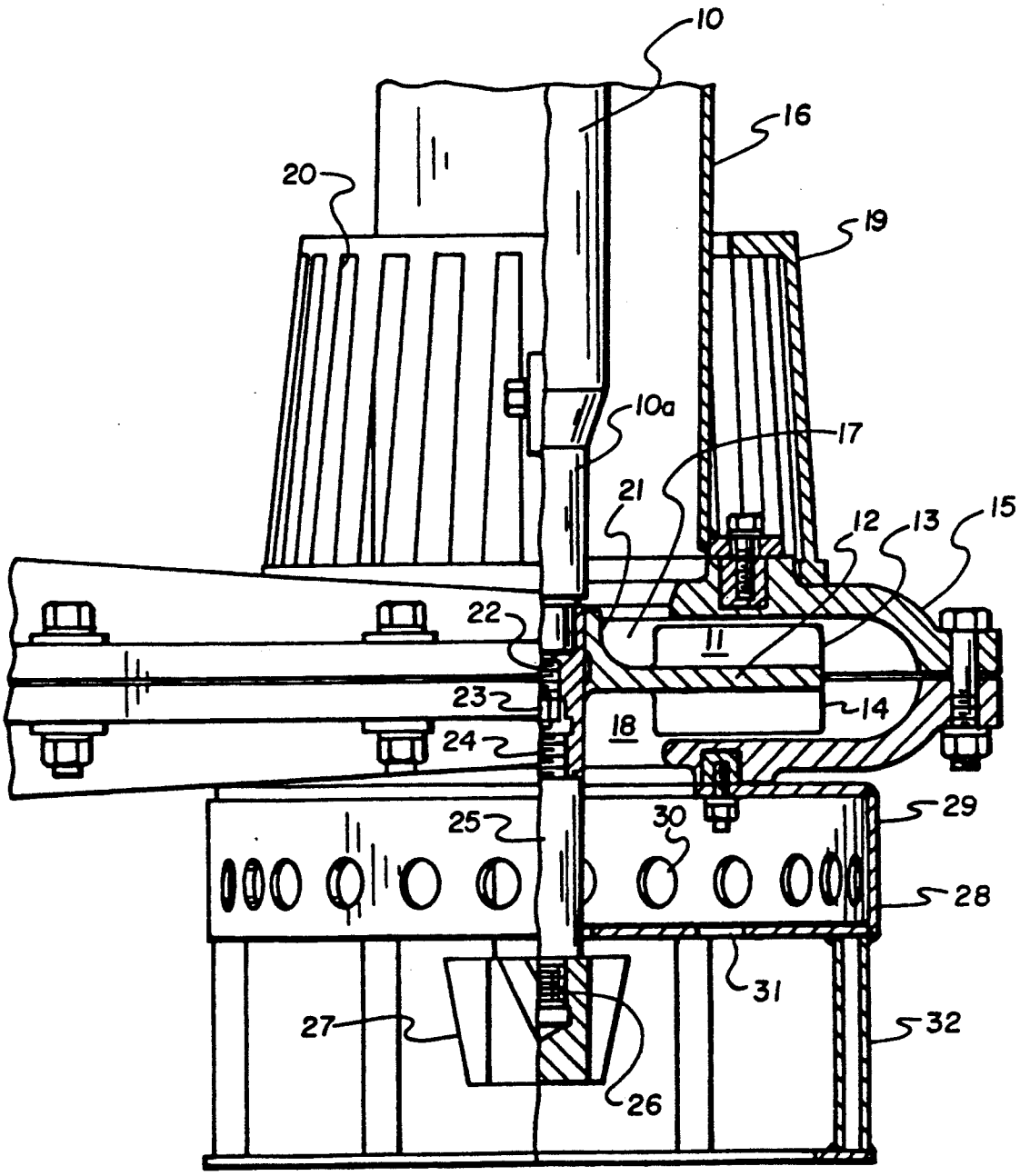
FIG. 2 is a dual suction submerged centrifugal pump having a remote motor and a dependent agitator axially attached beneath the impeller.

The upper portion of the pump apparatus of the instant invention is similar to that shown in FIG. 1 with the support plate bearing housing and motor being similarly situated. Thus, those items not illustrated in FIG. 2 may generally be viewed on FIG. 1.

The impeller is housed within a centrifugal pump housing 15 which is fixed in place and supported by a pump mounting column 16 which is preferably a large, annular pipe which is fastened at its upper end to the motor mounting support (not shown) and at its lower end to the upper surface of the centrifugal pump housing.

Inasmuch as the pump is a dual suction pump with an upper inlet 17, the support column 16 has openings through it in the vicinity of the upper inlet opening 17. The centrifugal pump housing also has a lower inlet opening at location 18.

The centrifugal pump housing 15 is generally located from about two feet to about six feet below a motor support plate (not shown). A motor support plate such as that shown in FIG. 1 is a practicable means for supporting the motor and by elongated depending members, for supporting the pump housing.

The drive shaft 10 is housed, generally concentrically, within the annular pump support column 16. Generally, the diameter of the drive shaft is only about one-half of the inside diameter of the support column. The inside diameter of the support member is usually as large or slightly larger than the diameter of the upper inlet opening of the pump. A flange around the lower end of the support column mates with a circular band around the upper inlet opening and the flange is bolted to the pump housing. The drive shaft generally has a short section near its lower end which has a reduced diameter. For stability purposes, most of the drive shaft is fairly thick with a short section which passes through the upper inlet of a diameter which is about one-half as thick as the long, upper portion of the shaft.

Although not shown in the instant drawing, for very large centrifugal pumps, especially those having a drive shaft of about six feet in length or longer and a very large pump housing, that is, an impeller having a diameter of about 20 inches or greater, additional pump housing support members may be run vertically between the motor support plate and the upper surface of the pump housing. A screen 19 encircles the annular support column 16 and has elongated, narrow openings 20 which preclude passage of any particles or agglomerate particles greater than the width of the opening slot 20. This is to prevent undesirably large particles or agglomerates from entering into the pump and interfering with the impeller.

In FIG. 2, the impeller has been particularly adapted to accommodate the addition of an agitator element or auger. The impeller hub 21 has a threaded upper bore 22 by means of which the impeller is threaded onto the drive shaft 10. A hex nut 23 may be fastened onto the end of the drive shaft to lock the impeller in position. At the lower end of the modified hub, a threaded bore 24 exists into which may be threaded a stub shaft 25 which is axially aligned with the drive shaft 10. At the lower terminus of stub shaft 25 is a threaded element 26 onto which an agitator element or auger 27 may be threaded. A cage 28 is affixed to the bottom surface of the centrifugal pump housing 15. The upper portion of the cage 29 is a shallow cylinder having opening ports 30 in the vertical sidewalls and ports 31 in the lower endplate of the cylinder. The remainder of the cage is constructed of spaced pillars 32, which may serve to protect the agitator while it is operating and to protect the agitator during installation and servicing, etc., especially since the agitator is at the free end of a rather long drive shaft. The cage or strainer does not interfere with the agitator being fully exposed to the slurry in which the pump is immersed.

In operation, the submerged pump will draw liquid, i.e., slurry, from a location in the vicinity of the upper screen 19 into the upper inlet opening 21. Generally, because of the settling characteristic of particles suspended in a liquid, the concentration of solids in the vicinity of the upper screen 19 is usually lower than the concentration of solids in the vicinity of the lower inlet 18, especially since agitation caused by auger 27 tends to stir and re-suspend particles which had settled onto the bottom of the tank. Because this is a double suction centrifugal pump, the volume of liquid being pumped by the upper vanes 13 is generally approximately the same as the volume being pumped by the lower vanes 14. Thus, approximately the same volume of slurry per unit of time is passing into both inlets 17 and 18. However, because of the greater concentration of solids in the agitated slurry between the bottom of the tank and the pump, the effective density of the slurry entering the lower inlet 18 will be greater than that entering the upper inlet 17. Since the pump has a common volute and a common discharge, effluent from the pump is a mixture of the slurry concentrations entering the two inlets. Thus, the density of the effluent is an average of the two densities of slurry entering the two inlet openings. (A greater solids concentration equates to a greater density for slurries in which the solid particles have a greater specific gravity than water, which is usually the case for most industrial slurries.) Thus, less horsepower is required to pump a certain rate (volume/unit time) of slurry which has a density which is the average of that entering the two inlets than if all the slurry were drawn by a single suction centrifugal pump from the bottom inlet into a single vaned impeller.

Because the auger is at the lower terminus of a fairly long drive shaft, the auger must be precisely balanced. To avoid any imbalance in either the auger or the impeller, both the impeller and the auger are made of very hard materials so as to minimize abrasion and erosion. Also, the diameter of the auger is maintained relatively narrow so long as a narrow diameter is consistent with the agitating action desired. Generally, the diameter of the auger will not exceed more than twice the length of the auger. The greater the diameter, the greater the vibration even for a small amount of imbalance at the periphery of the auger.

Generally, the auger is located about one auger's length below the lower portion of the pump housing 15. Stated another way, the length of the stub shaft exclusive of its threaded ends is approximately the same length as that of the auger. Also, it is desirable that the upper surface of the auger 27 is spaced a sufficient distance from end plate 31 to preclude undue abrasion on the upper auger surface by slurry being "trapped" between the end plate and the upper auger surface. The stub shaft has an exposed length of from about one-fourth to about twice the height of said auger.

In operation, the dual inlet pump of the instant invention has a dependent, i.e., suspended, exposed auger which agitates slurry in the proximity of the lower pump inlet. Some eddies may circulate also in the vicinity of the upper pump inlet. Many slurries such as mixtures of water and solid particles of high specific gravity are difficult to maintain in a slurried condition. The solid particles tend to settle, accumulating at the bottom of the slurry tank. Even equipping a typical slurry tank with an independent mixer such as a propeller mixer may minimize settling only in the vicinity of the mixer. Thus, an independent mixer with its shaft located remotely from a submerged pump may not affect the concentration of solids in the slurry pumped from the tank.

The dual inlet pump of the instant invention equipped with an axially extended agitator tends to cause increased flow (hydraulic) currents in the slurry contained within a vessel. The flow of slurry into the upper inlet tends to cause eddies and currents in the body of slurry above the submerged pump. These eddies and currents tend to minimize settling of solids. The agitation action and the flow of slurry into the lower pump inlet tend to circulate slurry in the body of slurry below the submerged pump. The agitation action tends to stir up solids deposited on the tank floor. An axial flow of fluid is directed downwardly by the agitator. Such flow is deflected by the tank floor to then circulate outwardly and upwardly to then blend into the flow of slurry into the pump inlets, especially the lower inlet. This combined action induced by the upper suction and lower suction of the pump and the agitation of the agitator provides enhanced circulation over that available from a single suction pump equipped with an agitator or from a double suction pump associated with a remote mixer. (Because of the size of the pump housing and its support members, it would be virtually impossible to locate a separate, independent propeller mixer, for example, in close proximity to the slurry zone immediately below the pump.)

To achieve the desired results from the instant invention the agitator element is affixed axially to, in effect, an extension of the impeller drive shaft. Thus, the impeller and agitator rotate in the same direction at the same rotational rate (rpm). The vanes on the agitator must be inclined so as to direct liquid flow axially away from the agitator.

The capacity of the dual suction pumps involved in the instant invention ranges from about ten gallons per minute (gpm) to about 5000 gpm although typically from about 20 gpm to 1000 gpm. The diameter of the discharge outlet may range from about one-half inch to about twelve inches.

A typical impeller diameter may range from about four inches in diameter up to about 20 inches or more. The diameter of the impeller will usually be about three to four times the maximum diameter of the auger.

A stub shaft suitable for use in the instant invention may range from about three inches in length, exclusive of threaded ends, up to about eight inches in length. Suitable augers may range in diameter from about three inches up to about 12 inches or more diameter at its widest dimension. Auger lengths may vary from about two inches up to about eight inches or more. Typically, the auger is a frustum of a cone with its base diameter larger than its height. The narrower portion of the auger is positioned more rearwardly from the pump housing than its base. The auger has a diameter which is from about one-half to twice its height.

The vanes or flights of the auger are usually from about one-fourth inch to about one inch or more in depth. The auger has blades which are about one-eighth to about one-half the maximum diameter of the auger.

Although various specific embodiments of the invention have been described herein, the invention is not intended to be limited thereby but to include the scope of invention as set forth in the appended claims.

We claim:

1. A tank-mounted, motor-driven, vertically-oriented submerged centrifugal slurry pump comprising:

a pump motor remote from said pump;

mounting means to mount said pump motor to a liquid-containing tank above the liquid level of said tank;

an elongated, pendant vertical drive shaft connected at its upper end to said motor and at its lower, free end to an impeller of said pump;

a dual action impeller having a central disk having a pair of opposed faces with impeller vanes on each face of said disk fitted within a dual-inlet pump housing, said impeller being attached to a free end of said shaft;

a dual-inlet, bearingless pump housing having an upper inlet and a lower inlet for housing said impeller located remote from said pump;

means to support said pump housing;

a cylindrical strainer cage attached over the lower pump inlet, said cage having openings therein and having an end plate member having a central opening aligned with said vertical drive shaft, said end plate member displaced downwardly from said pump lower inlet;

a stub shaft depending from and secured axially at its upper end to said impeller and extending through said end plate member; and an auger element attached to the lower free end of said stub shaft externally to said end plate member.

wherein said shaft stub has an exposed length of form about one-fourth to about twice the height of said auger, wherein said auger has a diameter which is from about one-half to about twice its height.

2. The pump of claim 1 wherein said pump is supported by a support plate which supports said pump housing by at least one elongated pump support means.

3. The pump of claim 2 wherein said pump support means is an elongated cylindrical support which supports said pump housing and substantially concentrically surrounds said drive shaft.

4. The pump of claim 1 wherein said impeller is substantially symmetrical about its vertical rotational axis and about a horizontal plane passing through the center of the disk element.

5. The pump of claim 1 wherein said auger has blades which are about one-eighth to about one-half the maximum diameter of said auger.

* * * * *

UNITED STATES PATENT AND TRADEMARK OFFICE

CERTIFICATE OF CORRECTION

PATENT NO. : 5,238,363

DATED : 8/24/93

INVENTOR(S) : Thielke et al.

It is certified that error appears in the above-indentified patent and that said Letters Patent is hereby corrected as shown below:

On the title page:
In the Abstract, line 4, after "shaft" insert --that is driven--;

In Column 1, line 39, change "3,873,866" to --3,973,866--;

In Column 1, line 53, after "one" insert --in--;

In Column 3, line 48, after "large" insert --as--;

In Column 4, line 29, change "21" to --17--;

In Column 6, line 49, after "member" change the period to a comma.

Signed and Sealed this

Nineteenth Day of April, 1994

*Attest:*

Bruce Lehman

BRUCE LEHMAN

*Attesting Officer*

*Commissioner of Patents and Trademarks*